US005706747A

United States Patent [19]

Tajima et al.

[11] Patent Number: 5,706,747

[45] Date of Patent: Jan. 13, 1998

[54] SEWING MACHINE

[75] Inventors: Ikuo Tajima; Minao Fukuoka, both of Kasugai, Japan

[73] Assignee: Tokai Kogyo Mishin Kabushiki Kaisha, Aichi-ken, Japan

[21] Appl. No.: 710,885

[22] Filed: Sep. 23, 1996

[30] Foreign Application Priority Data

Sep. 28, 1995 [JP] Japan ..... 7-251202

[51] Int. Cl.[6] ..... D05B 75/00; D05B 25/00

[52] U.S. Cl. ..... 112/258; 112/155; 112/119; 112/98

[58] Field of Search ..... 112/258, 155, 112/470.12, 470.13, 117, 119, 98, 259

[56] References Cited

U.S. PATENT DOCUMENTS 3,012,532 12/1961 Leslie ..... 112/258

3,783,811 1/1974 Schmedding et al. ..... 112/115 X 5,103,747 4/1992 Resta et al. ..... 112/117

5,287,820 2/1994 Stutznacker ..... 112/117

5,617,802 4/1997 Cash ..... 112/117

*Primary Examiner*—Paul C. Lewis

*Attorney, Agent, or Firm*—Dennison, Meserole, Pollack & Scheiner

[57] ABSTRACT

A sewing machine includes a sewing head having a sewing needle to be vertically reciprocally driven, and a shuttle base having a shuttle to be rotatably driven in synchronism with the vertical movement of the sewing needle for forming stitches. A machine frame includes a pair of support posts spaced laterally from each other, an upper frame having greater rigidness for mounting the sewing head thereon, and a lower frame having greater rigidness and disposed below the upper frame for mounting the shuttle base thereon. Each of the upper frame and the lower frame extends between the pair of support posts and is fixed thereto.

12 Claims, 8 Drawing Sheets

SEWING MACHINE

FIELD OF THE INVENTION

The present invention relates to a sewing machine which includes a sewing head having a sewing needle to be vertically reciprocally driven and which includes a shuttle base having a shuttle to be rotatably driven in synchronism with the vertical movement of the sewing needle so as to cooperate therewith for forming stitches.

DESCRIPTION OF THE PRIOR ART

A conventional sewing machine includes a machine frame which has a base frame made of a plurality of steel profiles, a pair of boxes fixed to an upper surface of the base frame on both right and left sides thereof, and a square pipe-like frame member extending between upper surfaces of the boxes and having both ends fixed to the corresponding boxes. A sewing head is fixed to the square pipe-like frame member, and a shuttle base is fixed to the base frame.

In order to reduce vibrations which may be produced due to the vertical reciprocal movement of a sewing needle or due to the rotation of the shuttle for forming stitches, channel steels or L-steels are used for the steel profiles of the base frame, and a large number of such steel profiles are used for improving the strength of the whole machine frame and for consequently improving the rigidness of the whole machine frame. However, with this measure, as the rigidness of the machine frame is improved, the construction of the base frame becomes complicated and the weight of the machine frame is increased.

SUMMARY OF THE INVENTION

It is, accordingly, an object of the present invention to provide a sewing machine in which vibrations of a machine frame can be effectively reduced without providing a complicated construction of a base frame.

It is also an object of the present invention to provide a sewing machine in which vibrations of a machine frame can be effectively reduced without increasing weight of the machine frame.

It is a further object of the present invention to provide a sewing machine in which vibrations of a shuttle base can be effectively reduced.

According to a first aspect of the present invention, there is provided a sewing machine comprising:

a sewing head having a sewing needle to be vertically reciprocally driven;

a shuttle base having a shuttle to be rotatably driven in synchronism with the vertical movement of the sewing needle for forming stitches; and a machine frame including a pair of support posts spaced laterally from each other, an upper frame having greater rigidness for mounting the sewing head thereon, and a lower frame having greater rigidness and disposed below the upper frame for mounting the shuttle base thereon;

each of the upper frame and the lower frame extending between said pair of support posts and being fixed thereto.

Thus, with this first aspect, only the upper and lower frames to which the sewing head and the shuttle base or vibration producing sources are mounted are greater in rigidness. Therefore, in comparison with the conventional construction to provide greater rigidness in all elements of the machine frame, the machine frame according to the first aspect is simple in construction and is lightweight while vibrations of the machine frame can be reduced.

Preferably, the upper frame and the lower frame are fixed to the support posts by means of welding or like operation so as to form an integral construction of the machine frame.

In addition, it is advantageous that the shuttle base mounted on the lower frame via a vibration absorbing member.

Further, the sewing machine may include a stay extending between the pair of support posts and fixed thereto, and a table supported on the stay for placing thereon a holder frame on which a work to be sewn is set.

A thread supply device may be mounted on the upper frame for supplying a thread to the sewing needle.

According to a second aspect of the present invention, there is provided a sewing machine comprising:

a sewing head having a sewing needle to be vertically reciprocally driven;

a shuttle base having a shuttle to be rotatably driven in synchronism with the vertical movement of the sewing needle for forming stitches; and a machine frame for mounting the sewing head and the shuttle base thereon;

the shuttle base being mounted on the machine frame via a vibration absorbing member.

According to a third aspect of the present invention, there is provided a sewing machine comprising:

a multi-needle type sewing head having a plurality of sewing needles, one of the sewing needles being selected to be vertically reciprocally driven;

a shuttle base having a shuttle to be rotatably driven in synchronism with the vertical movement of the selected sewing needle for forming stitches; and a thread passage device disposed above the sewing head for supplying threads to the sewing needles;

the thread passage device including a thread passage member having guide recesses formed therein in the same number as the sewing needles, and a presser adapted to be pressed on the thread passage member, so that all the threads to be supplied to the sewing needles are held and released at one time by pressing and releasing the presser.

The invention will become more apparent from the appended claims and the description as it proceeds in connection with the drawings.

DETAILED DESCRIPTION OF THE PREFERRED EMBODIMENT

Figure 1:
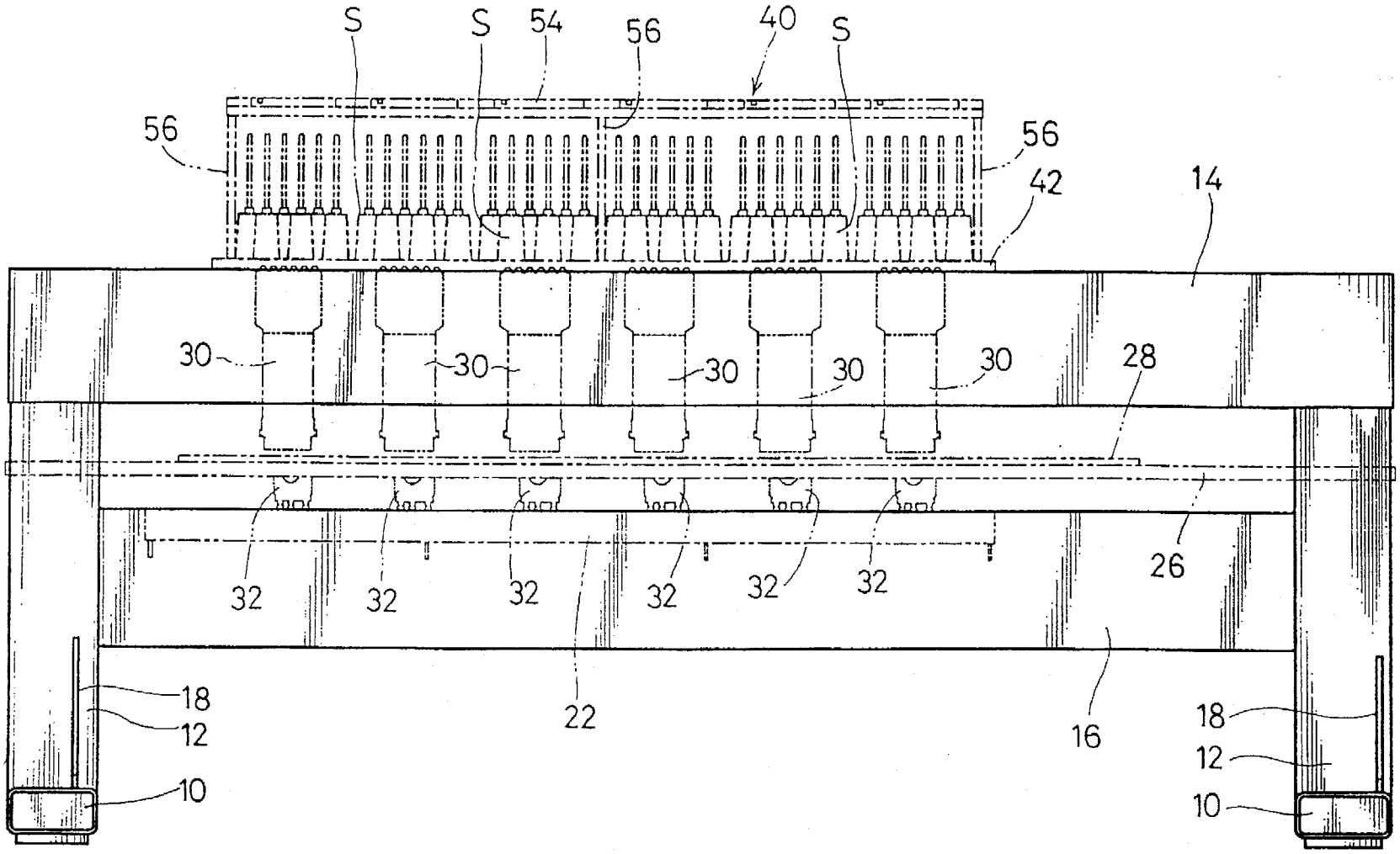
FIG. 1 is a front view of a machine frame of a sewing machine according to an embodiment of the present invention.
Figure 2:
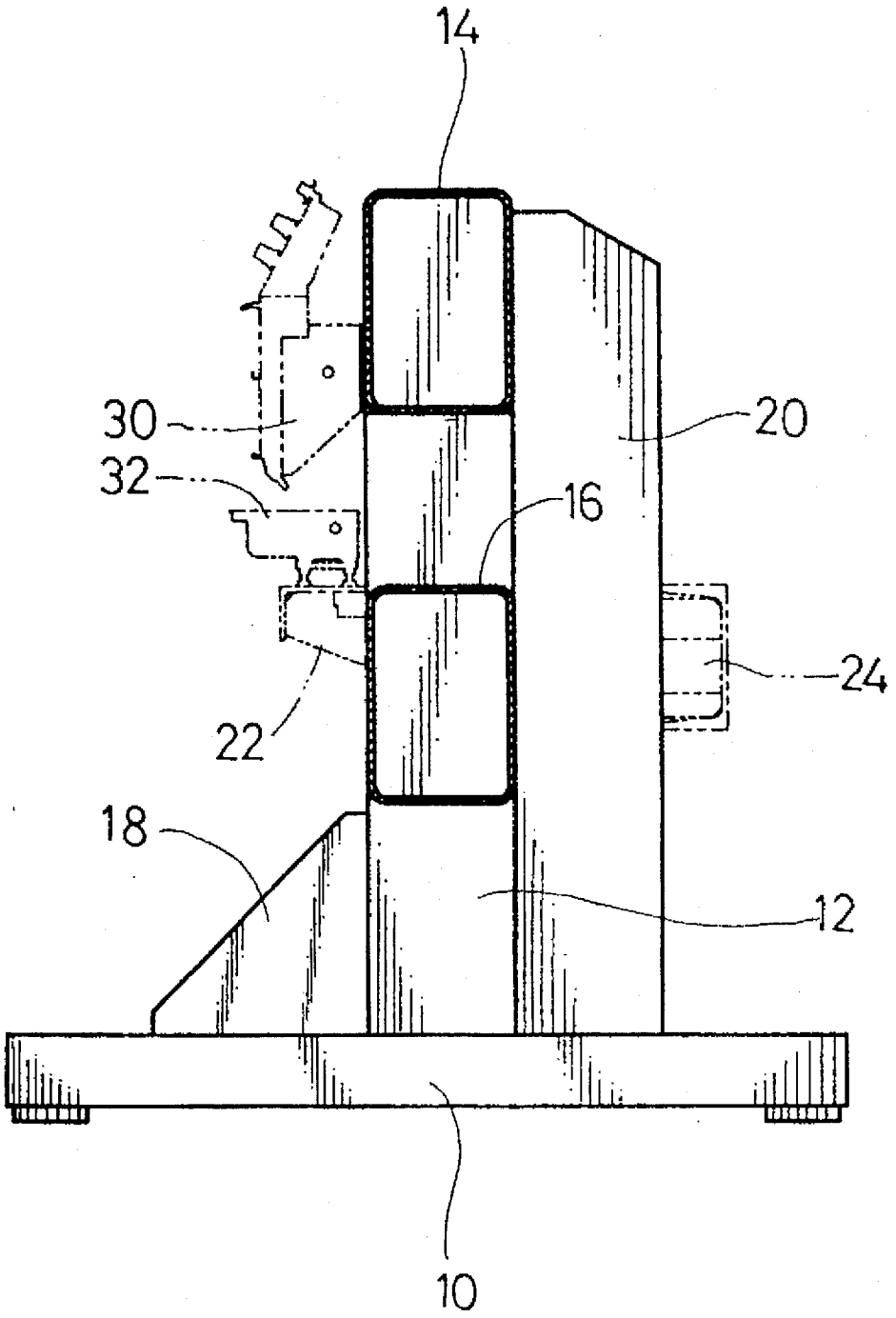
FIG. 2 is a side view of the machine frame.
Figure 3:
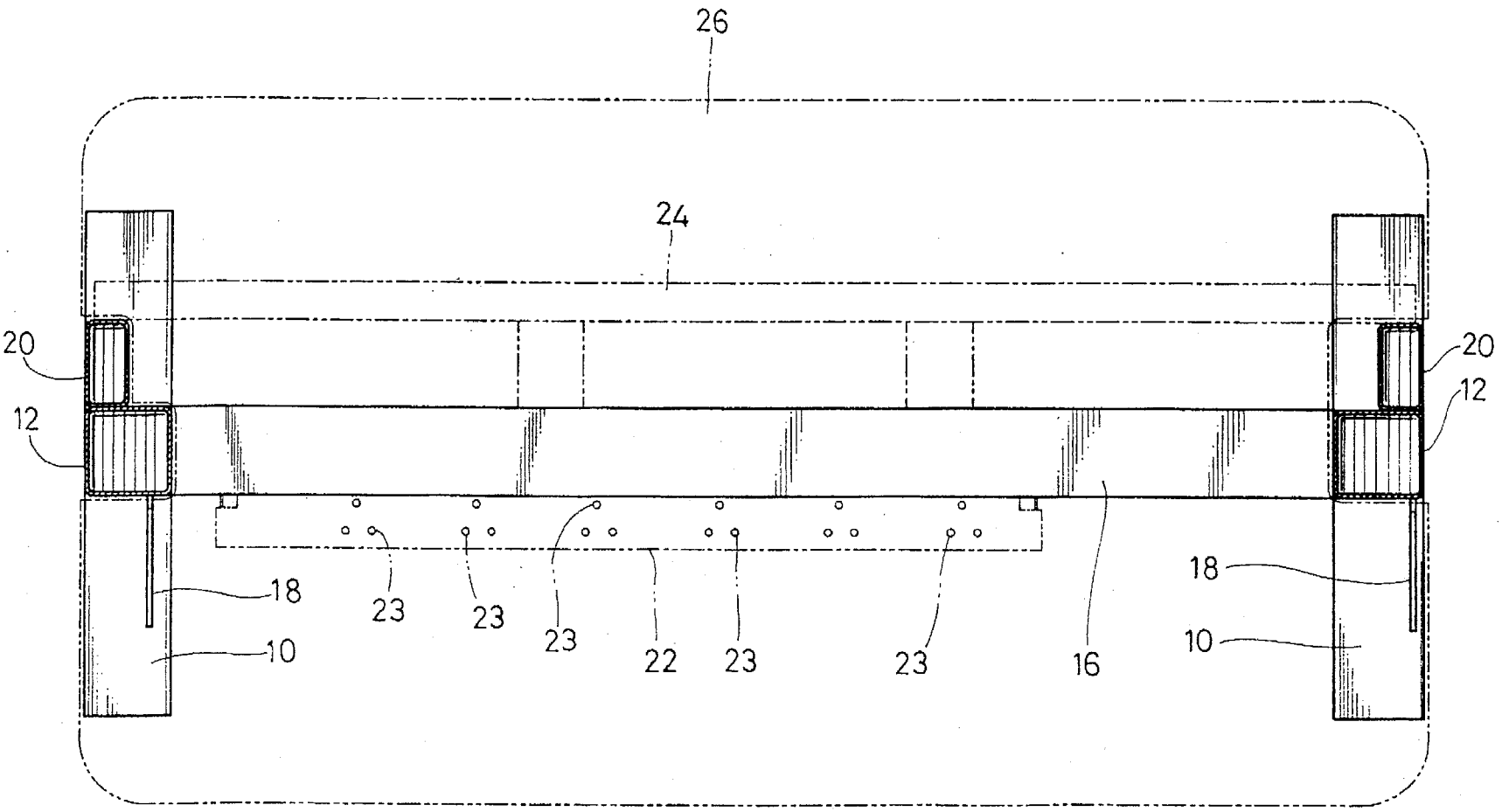
FIG. 3 is a plan view of the machine frame.
Figure 4:
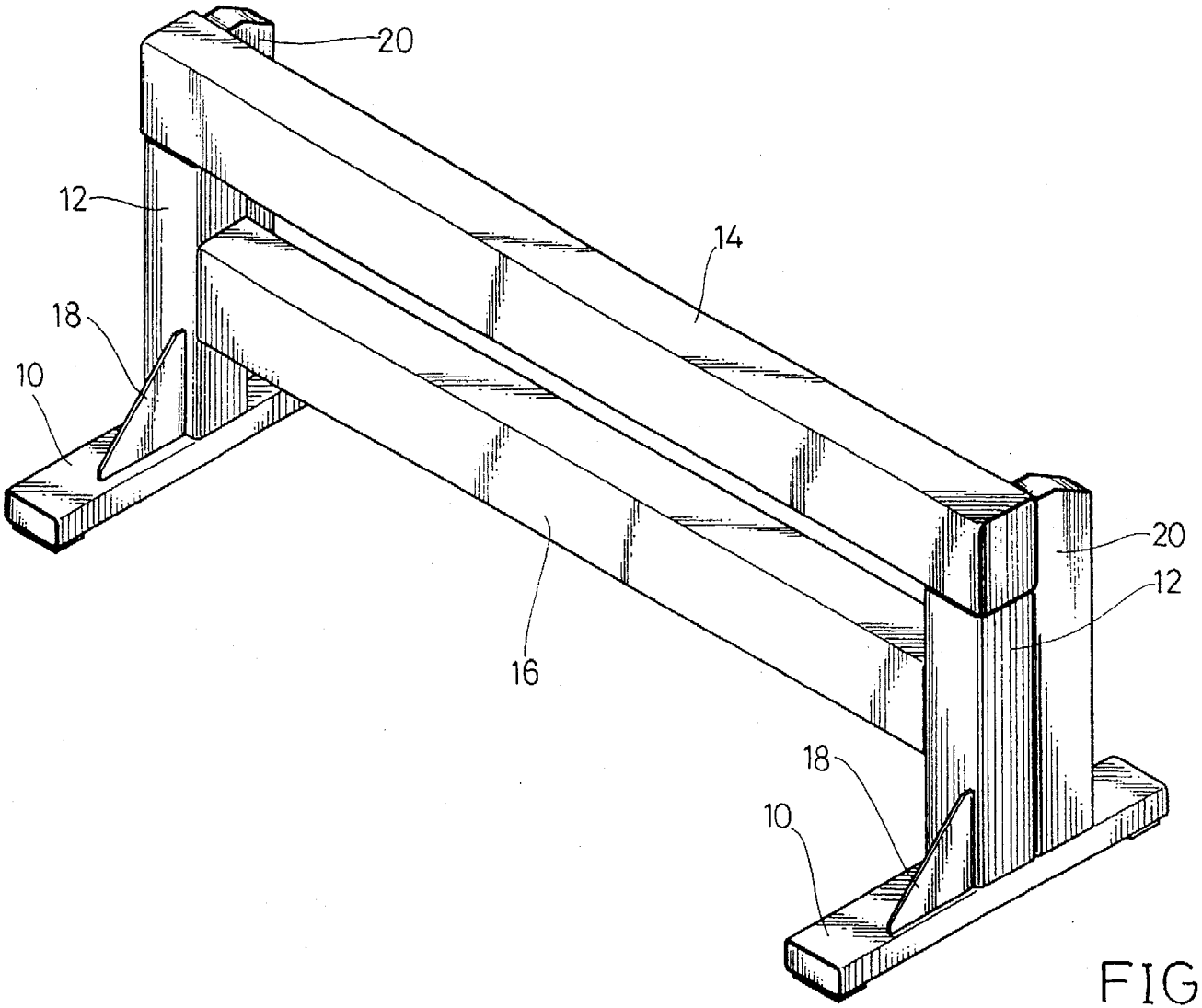
FIG. 4 is a perspective view of the machine frame.

An embodiment of the present invention will now be explained with reference to the drawings.

A machine frame of a sewing machine is shown in front view, side view, plan view and perspective view in FIGS. 1, 2, 3 and 4, respectively.

As shown in these figures, right and left side bases 10 are spaced laterally from each other; Support posts 12 extend vertically upwardly from upper surfaces of the bases 10 and are fixed thereto, respectively. An upper frame 14 and a lower frame 16 extend between the support posts 12, respectively. Both the upper frame 14 and the lower frame 16 have a square pipe-like configuration, so that they have greater rigidness. The upper frame 14 has both ends fixed to upper surfaces of the support posts 12. The lower frame 16 has both ends fixed to the support posts 12 at their middle positions in the vertical direction. It will be preferable that the support posts 12 also have greater rigidness.

A reinforcing rib 18 is fixed to the front side of each of the support posts 12 and to the upper surface of the corresponding base 10 so as to increase the connecting strength between each support post 12 and its corresponding base 10. An auxiliary post 20 has a lower end fixed to each of the bases 10. The auxiliary post 20 is disposed on the rear side of the corresponding support post 12 and is fixed to the support post 12 and to the upper frame 14. The auxiliary post 20 serves to increase connecting rigidness between the corresponding base 10 and the support post 12 and between the corresponding support post 12 and the upper frame 14. The above elements constituting the machine frame are fixed to each other by means of welding or like operation.

A base support 22 is fixed to the front surface of the lower frame 16. A table 26 is disposed between the upper frame 14 and the lower frame 16. A stay 24 has both ends fixed to the rear surfaces of the auxiliary posts 20. A holder frame 28 for setting thereon a work such as a cloth to be sewn is placed on the table 26. Studs (not shown) for supporting the table 26 and a drive mechanism (not shown) for moving the holder frame 28 are mounted on the stay 24. As shown in FIG. 1, a plurality of sewing heads 30 (six in this embodiment) are mounted on the front surface of the upper frame 14 and are arranged in the lateral direction. A spool holder device 40 is mounted on the upper surface of the upper frame 14. A plurality of shuttle bases 32 are mounted on the base support 22 and are positioned in alignment with their corresponding sewing heads 30.

Each of the sewing heads 30 is of a multi-needle type and is provided with a plurality of sewing needles (not shown) which are six in number, for example. In each sewing head 30, one of the needles is selected and is vertically reciprocally driven. Each of the shuttle bases 32 includes a shuttle **32*a* (see FIG. 5) disposed therein and is rotatably driven in synchronism with the vertical movement of the selected needle of the corresponding sewing head 30. Thus, stitches are formed on the work held by the holder frame 28 through the vertical movement of the selected sewing needle and the rotation of the corresponding shuttle 32*a* in a well-known manner while the holder frame 28** is moved during the sewing operation.

Figure 5:
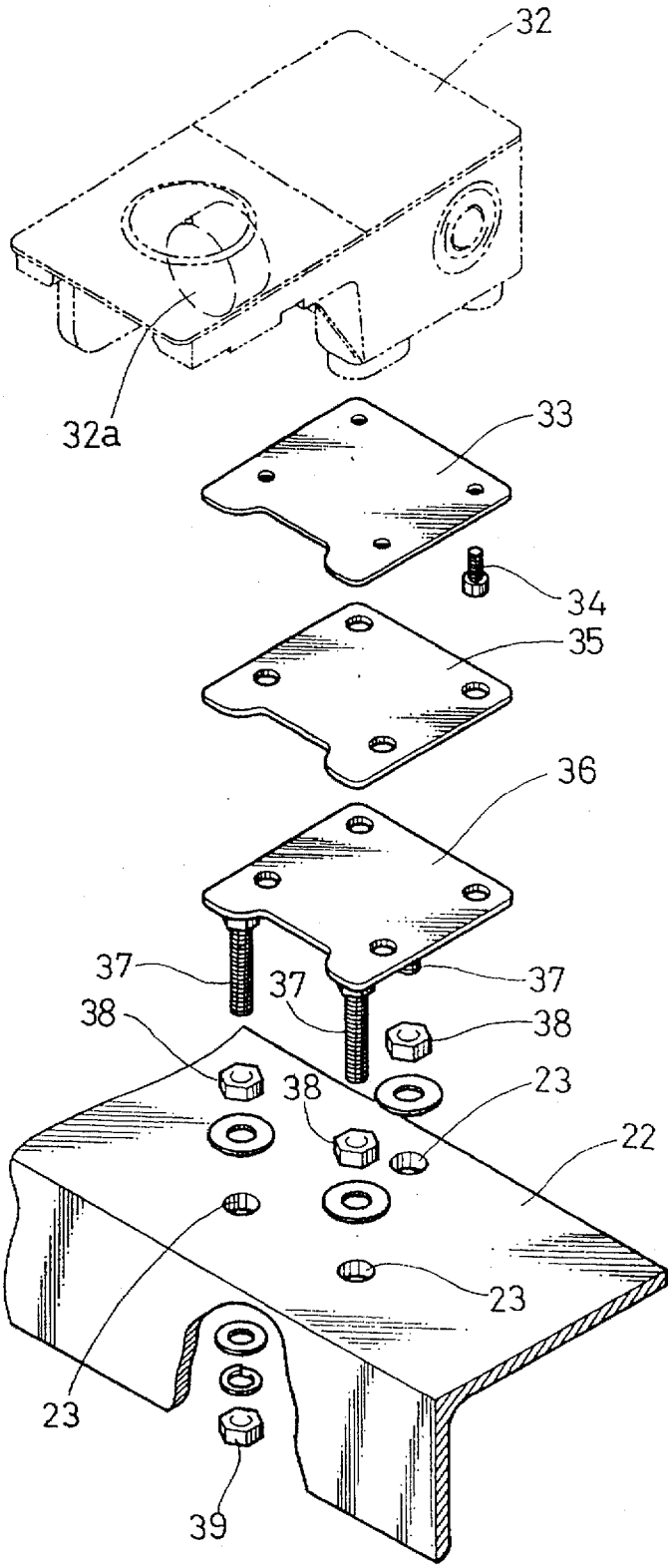
FIG. 5 is an exploded perspective view showing the support structure of one of shuttle bases of the sewing machine.

The support structure of one of the shuttle bases 32 is shown in exploded perspective view in FIG. 5. As shown in FIG. 5, a plate 33 is secured to the lower surface of the shuttle base 32 by means of four screws 34 (only one shown in FIG. 5). A fixing plate 36 is bonded to the lower surface of the plate 33 while a damper rubber 35 as a vibration absorbing member is interposed between the plate 33 and the fixing plate 36 in surface-to-surface contacting relationship with the plate 33 and the fixing plate 36. Three bolts 37 are fixed to the lower surface of the fixing plate 36 for insertion into holes 23 formed in the base support 22. Nuts 38 and 39 are screwed on each of the bolts 37 and are positioned on the upper side and the lower side of the base support 22, respectively. The nut 39 is tightened to clamp the base support between the nuts 38 and 39. Thus, the mounting height as well as the inclination of the shuttle base 32 relative to the base support 22 can be adjusted by varying the positions of the nuts 38 along their corresponding bolts 37.

As described above, the shuttle base 32 is supported on the base support 22 via the damper rubber 35, so that the vibrations of the shuttle base 32 which may be produced when the shuttle **32*a* is rotatably driven can be absorbed by the damper rubber 35. Thus, the transmission of vibrations from the shuttle base 32 to the support base 22** can be prevented.

Figure 6:
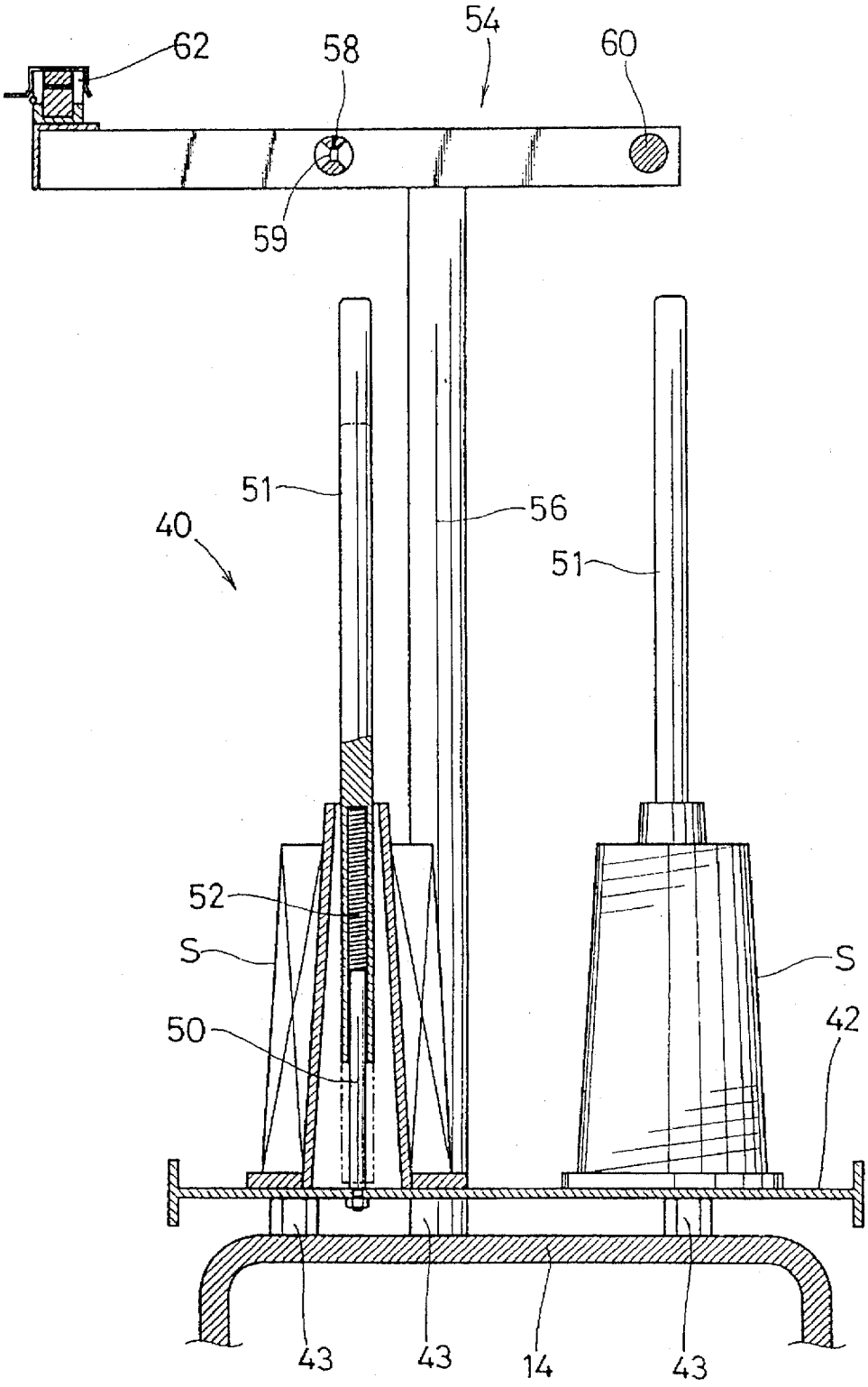
FIG. 6 is a partial sectional view of a spool holder of the sewing machine.

The detailed construction of the spool holder device 40 is shown in FIG. 6 in a partial sectional view. A part of the spool holder device 40 associated with one sewing head 30 is shown in perspective view in FIG. 7. The spool holder device 40 includes a holder base 42 and a thread passage mechanism 54 (see FIG. 1). The holder base 42 is disposed on the upper frame 14 and extends laterally over the sewing heads 30. The thread passage mechanism 54 is positioned above the holder base 42.

As shown in FIG. 6, the holder base 42 is fixed to the upper surface of the upper frame 14 by means of studs 43. A group of spool pins 50 associated with each sewing head 30 are secured to the upper surface of the holder base 42. The group of spool pins 50 includes the spool pins 50 which are equal in number of the sewing needles in each sewing head 30. A spool S is set on each spool pin 50. A guide rod 51 is connected to each spool pin 50. The guide rod 51 has a lower tubular portion which receives the upper portion of the spool pin 50. A coil spring 52 is disposed within the lower tubular portion for normally biasing the guide rod 51 upwardly. With this construction, by downwardly pressing the guide rod 51 against the biasing force of the coil spring 52, the spool S can be set on or removed from the spool pin 50 without removing the guide rod 51 from the spool pin 50.

Figure 7:
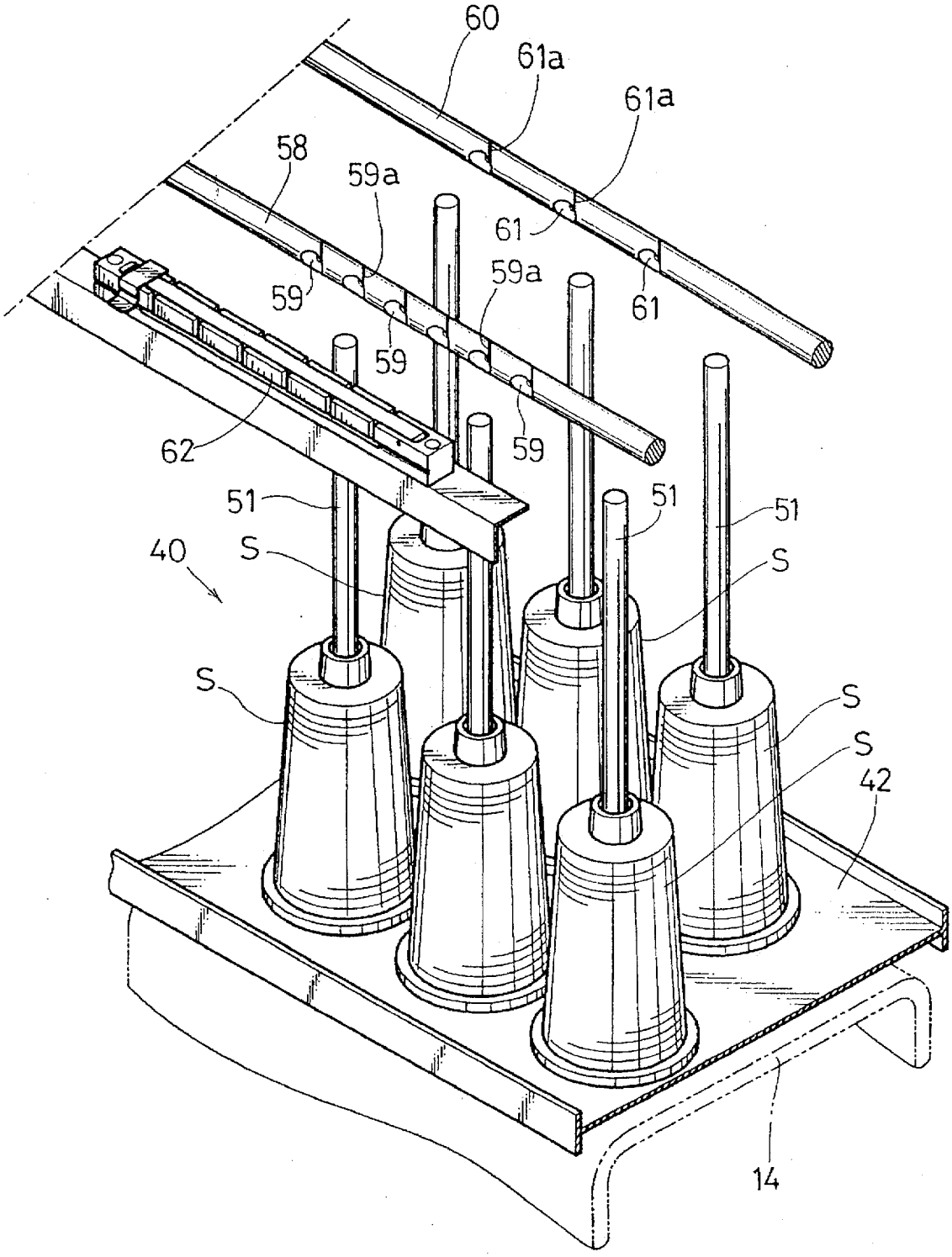
FIG. 7 is a perspective view of a part of the spool holder associated with one of sewing heads of the sewing machine.

As shown in FIGS. 1 and 6, the thread passage mechanism 54 is supported by support rods 56 which are fixed to the upper surface of the upper frame 14. The thread passage mechanism 54 includes a first guide rod 58 and a second guide rod 60. As shown in FIG. 7, the first guide rod 58 includes a group of thread passage holes 59 which are six in number and are associated with each sewing head 30. The second guide rod 60 includes a group of thread passage holes 61 which are three in number and are associated with each sewing head 30. As shown in FIG. 6, each of the thread passage holes 59 and 61 has both open ends enlarged outwardly. A slit **59*a* is formed in the first guide rod 58 in continuity with each thread passage hole 59 and serves to guide a thread from the upper side of the periphery of the first guide rod 58 to each thread passage hole 59. A slit 61*a* is formed in the second guide rod 60 in continuity with each thread passage hole 61 and serves to guide a thread from the upper side of the periphery of the second guide rod 60 to each thread passage hole 61**.

Figure 8:
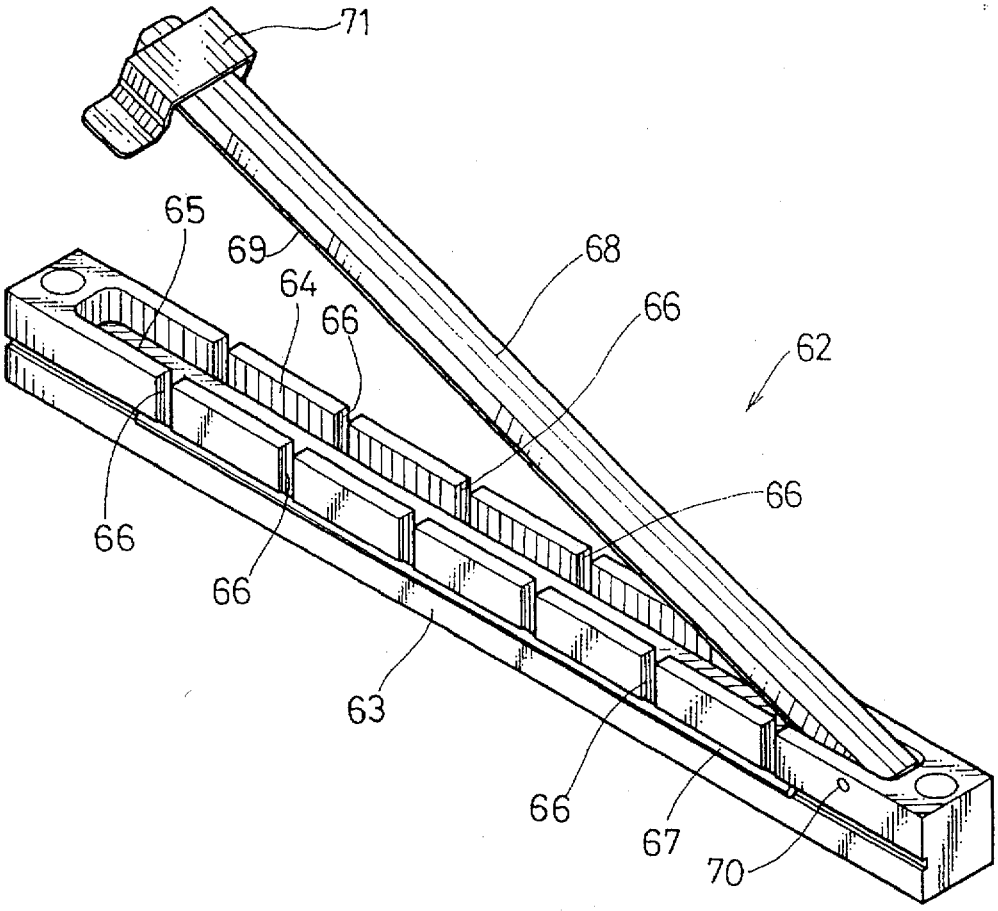
FIG. 8 is a perspective view of one of thread passage devices.

In addition, the thread passage mechanism 54 includes a thread passage member 62 associated with each sewing head 30. As will be seen from FIGS. 8 and 9 which show the thread passage member 62 in perspective view and cross sectional view, respectively, the thread passage member 62 includes a base 63 and a presser 68. A recess 64 is formed on the upper surface of the base 63 and is adapted to receive the presser 68. The recess 64 has a bottom to which a felt strip 65 is bonded. Slits 66 are formed in the base 63 on both sides of the recess 64 and are equal in number (six in this embodiment) to the sewing needles of the corresponding sewing head 30. A guide bar 67 is fixed to the front surface of the base 63 for preventing breaking of the threads at the bottom corners of the slits 66.

Figure 9:
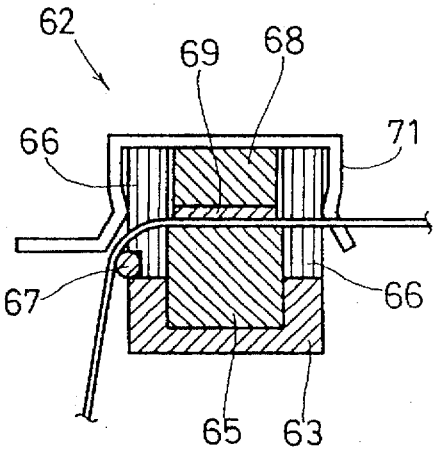
FIG. 9 is a vertical sectional view of the thread passage device.

The presser 68 has one end pivotally connected to the base 63 by means of a pin 70 for opening and closing the recess 64. A leaf spring 71 is secured to the other end of the presser 68. When the presser 68 is received within the recess 64 of the base 63 as shown in FIG. 9, the leaf spring 71 is resiliently pressed on both front and rear surfaces of the base 63, so that the presser 68 is held in position. Here, a felt strip 69 is bonded to the lower surface of the presser 68.

The paths of the threads in the spool holder device 40 will now be explained. The threads drawn out from a front array of the spools S on the front side of the spool base 42 are passed through the thread passage holes 59 of the first guide rod 58 and the thread passage member 62 and then reach the corresponding sewing head 30. On the other hand, the threads drawn out from a rear array of the spools S on the rear side of the spool base 42 are passed through the thread passage holes 61 of the second guide rod 60, the thread passage holes 59 of the first guide rod 58 and the thread passage member 62 and then reach the corresponding sewing head 30.

Since the thread wound on each spool S is twisted as it drawn out from the spool S, a part of the thread may be entangled in a loop-like form when the thread is loosened between the spool S and the first guide rod 58 or the second guide rod 60. However, with the provision of the guide rod 51 on the spool pin 50, the thread is drawn out from the spool S while the thread is coiled around the guide rod 51, so that the thread may not be entangled.

The handling operation of the threads required for the first guide rod 58 and the second guide thread 60 is only the operation for passing the threads through the thread passage holes 59 via the corresponding slits 59*a* and through the passage holes 61 via the corresponding slits 61*a*. Further, the handling operation of the threads required for the thread passage member 62 is only the operation for passing the threads through the slits 66 of the base 63 with the presser member 68 pivoted to open the base 63, and for moving the presser member 68 to close the base 63.

During the sewing operation, the vibrations may be produced at the sewing heads 30 and at the shuttle bases 32 having the shuttles 32*a* to be rotated. With this embodiment, the sewing heads 30 are mounted on the upper frame 14 having greater rigidness, and the shuttle bases 32 are mounted on the lower frame 16 also having greater rigidness via the base support 22. Therefore, vibrations of the whole machine frame can be reduced while the machine frame is simple in construction.

Although the above embodiment is described in connection with a sewing machine having a plurality of sewing heads 30 of multi-needle type, the same machine frame can be adapted to a sewing machine having a plurality of sewing heads of single-needle type or a sewing machine having a single sewing head of single-needle type.

While the invention has been described with reference to a preferred embodiment thereof, it is to be understood that modifications or variations may be easily made without departing from the spirit of this invention which is defined by the appended claims.

What is claimed is:

1. A sewing machine comprising:

a sewing head having a sewing needle to be vertically reciprocally driven;

a shuttle base having a shuttle to be rotatably driving in synchronism with the vertical movement of the sewing needle for forming stitches; and a machine frame including a pair of support posts of predetermined rigidness spaced laterally from each other, an upper frame for mounting the sewing head thereon, and a lower frame disposed below said upper frame for mounting the shuttle base thereon;

each of said upper frame and said lower frame extending between said pair of support posts and being fixed thereto; and each of said upper frame and said lower frame having rigidness greater than that of said support posts.

2. The sewing machine as defined in claim 1 wherein said upper frame and said lower frame are fixed to said support posts by means of welding so as to form an integral construction of said machine frame.

3. The sewing machine as defined in claim 1 wherein said shuttle base is mounted on said lower frame via a vibration absorbing member.

4. The sewing machine as defined in claim 1 further including thread supply means mounted on said upper frame for supplying a thread to the sewing needle.

5. A sewing machine comprising;

a sewing head having a sewing needle to be vertically reciprocally driven;

a shuttle base having a shuttle to be rotatably driven in synchronism with the vertical movement of the sewing needle for forming stitches; and a machine frame including a pair of support posts spaced laterally from each other, an upper frame for mounting the sewing head thereon, and a lower frame disposed below said upper frame for mounting the shuttle base thereon;

each of said upper frame and said lower frame extending between said pair of support posts and being fixed thereto;

a stay extending between said pair of support posts and fixed thereto; and a table supported on said stay for placing thereon a holder frame of which a work to be sewn is set.

6. A sewing machine comprising:

at least one sewing head having a sewing needle to be vertically reciprocally driven;

at least one shuttle base having a shuttle to be rotatably driven in synchronism with the vertical movement of the sewing needle for forming stitches; and a machine frame for mounting said at least one sewing head and said at least one shuttle base thereon;

said at least one shuttle base being mounted on said machine frame via an associated vibration absorbing member;

said vibration absorbing member having a flat plate-like configuration and having upper and lower surfaces;

said at least one shuttle base having a first flat plate mounted thereon;

said frame having a second flat plate mounted thereon;

said vibration absorbing member being interposed between said first flat plate and said second flat plate, so that said upper surface and said lower surface of said vibration absorbing member contact said first flat plate and said second flat plate in surface-to-surface contacting relationship therewith.

7. The sewing machine as defined in claim 6 wherein said at least one sewing head comprises a plurality of sewing heads and said at least one shuttle base comprises a plurality of shuttle bases.

8. The sewing machine as defined in claim 6 wherein each of said first flat plate and said second flat plate has a surface area substantially equal to that of said upper and lower surfaces of said vibration absorbing member.

9. The sewing machine as defined in claim 8 wherein said first flat plate is bonded to said second flat plate with said vibration absorbing member interposed between said first flat plate and said second flat plate.

10. The sewing machine as defined in claim 6 further including means for adjusting the position of said shuttle base relative to said frame.

11. The sewing machine as defined in claim 6 including means for vertically adjusting said at least one shuttle base relative to said frame.

12. A sewing machine comprising:

a multi-needle type sewing head having a plurality of sewing needles, one of said sewing needles being selected to be vertically reciprocally driven;

a shuttle base having a shuttle to be rotatably driven in synchronism with the vertical movement of the selected sewing needle for forming stitches; and thread passage means disposed above the sewing head for supplying threads to said sewing needles;

said thread passage means including a thread passage member having guide slits formed therein in the same number as the sewing needles, and a presser adapted to be pressed on said thread passage member, so that all the threads to be supplied to said sewing needles are held and released at one time by pressing and releasing said presser.

* * * * *